US007969260B2

(12) United States Patent
Raty

(10) Patent No.: US 7,969,260 B2
(45) Date of Patent: Jun. 28, 2011

(54) VARIABLE RADIO FREQUENCY BAND FILTER

(75) Inventor: Tuomo T. T. Raty, Pattijoki (FI)

(73) Assignee: Nokia Siemens Networks Oy, Espoo (FI)

( * ) Notice: Subject to any disclaimer, the term of this patent is extended or adjusted under 35 U.S.C. 154(b) by 220 days.

(21) Appl. No.: 12/379,936

(22) Filed: Mar. 4, 2009

(65) Prior Publication Data

US 2009/0237185 A1 Sep. 24, 2009

(30) Foreign Application Priority Data

Mar. 4, 2008 (EP) ..... 08004027

(51) Int. Cl.
*H01P 1/205* (2006.01)
*H01P 1/202* (2006.01)

(52) U.S. Cl. ..... 333/203; 333/202; 333/207

(58) Field of Classification Search ..... 333/202, 333/206, 207, 209, 222–225, 233, 235
See application file for complete search history.

(56) References Cited

U.S. PATENT DOCUMENTS

| | | | | |
|---|---|---|---|---|
| 6,366,184 | B1 * | 4/2002 | Ohtonen | 333/202 |
| 6,933,811 | B2 * | 8/2005 | Enokihara et al. | 333/202 |
| 7,205,868 | B2 * | 4/2007 | Park et al. | 333/203 |
| 2005/0219013 | A1 * | 10/2005 | Kumar et al. | 333/203 |

FOREIGN PATENT DOCUMENTS

| | | |
|---|---|---|
| EP | 1 885 018 | 2/2008 |
| JP | 62-209901 | 9/1987 |

* cited by examiner

*Primary Examiner* — Seungsook Ham
(74) *Attorney, Agent, or Firm* — Staas & Halsey LLP

(57) ABSTRACT

A variable radio frequency band filter includes a housing with a plurality of cavities, a plurality of resonators, wherein one resonator is arranged in each cavity, and a tuning arrangement having a plurality of tuning structures. One of the tuning structures is arranged in each of the cavities. The tuning structures of multiple cavities are mechanically connected such that the tuning structures may be shifted simultaneously in order to simultaneously vary the resonance frequencies of the cavities. Each tuning structure includes at least one first metallic surface facing the resonator and at least one second metallic surface facing a wall of the cavity, the first and second metallic surfaces being conductively connected. The second metallic surface is arranged such that a small and essentially uniform gap is formed between the second metallic surface and the wall to achieve a virtual grounding of the metallic surfaces.

26 Claims, 6 Drawing Sheets

VARIABLE RADIO FREQUENCY BAND FILTER

CROSS REFERENCE TO RELATED APPLICATIONS

This application is based on and hereby claims priority to European Application No. EP08004027 filed on Mar. 4, 2008, the contents of which are hereby incorporated by reference.

BACKGROUND OF THE INVENTION

The invention relates to variable radio frequency band filters, in particular to software tunable duplex filters, as used in radio access technology.

In the field of variable radio frequency band filters, various attempts have been made to provide for electromechanical tuning and/or adjusting the resonance frequencies of multiple coupled cavities in a radio frequency band filter simultaneously. Variable radio frequency band filters according to the related art usually comprise tuning screws protruding from a top wall of the cavity formed by a lid, wherein the resonance frequencies of the cavities can be individually tuned using these tuning screws just as in fixed band filters. In order to tune the filter, variable radio frequency band filters include various devices for simultaneously tuning plural cavities.

The document U.S. Pat. No. 7,205,868 B2 teaches to provide variable radio frequency band filters in an arrangement comprising a tuning support supporting tuning rods of preferably dielectric material with a large dielectric constant. By moving the tuning support, the tuning rods may be approached to the top surface of an essentially cylindrical resonator placed in the respective cavities. The proximity of the dielectric material influences the resonance frequency of the resonator, such that the arrangement may be tuned by moving the tuning rods using the tuning support. The tuning support mechanically connects the tuning rods such that the tuning rods may be shifted simultaneously in order to simultaneously vary a resonance frequency of multiple cavity/resonator systems. In order to obtain a sensible tuning range, the tuning rods according to the document U.S. Pat. No. 7,205,868 B2 have to be placed in a very close proximity to the resonator.

SUMMARY

One potential object is to provide a variable radio frequency band filter, in particular a quarter-wave length coaxial resonator filter, wherein dielectric losses are avoided and wherein a high Q-factor may be achieved.

A further potential object is to provide a variable frequency band filter with a particularly robust and fault tolerant tuning arrangement, which is cheap and easy to manufacture.

The inventor proposes a variable radio frequency band filter that has a housing with a plurality of cavities, a plurality of resonators, each resonator being arranged in one of the cavities and a tuning arrangement for simultaneously tuning the resonance frequency of the cavities. According to further embodiments, plural resonators may be arranged in one cavity.

The tuning arrangement comprises a plurality of tuning structures, each tuning structure being associated to one of the cavities and to the resonator in this cavity. The tuning structures of multiple cavities among the plurality of cavities may be mechanically connected such that the tuning structures may be shifted simultaneously in order to simultaneously vary or adapt a resonance frequency of the respective cavities.

Moreover, each of the tuning structures includes at least one first metallic surface facing the resonator and at least one second metallic surface facing a wall of the cavity, wherein the first and second metallic surfaces are conductively connected.

In order to achieve a variable radio frequency band filter with a wide tuning range having at the same time a large Q-factor, it is proposed that the second metallic surface is arranged such that a small and essentially uniform gap is formed between the second metallic surface and the wall of the cavity in order to achieve a virtual grounding of the metallic surfaces. In order to achieve such a virtual grounding, the gap between the second surface and the wall should preferably be such that a capacitance formed between the second metallic surface and the wall is at least 3 pF. In further embodiments, wherein the virtual grounding is even more perfect, the capacitance may be around 10 pF or more. The higher the capacitance, the better the virtual grounding. In general, the needed capacitance depends on frequency.

The proposed device may be applied to any type of variable radio frequency band filter including quarter-wavelength resonators, half-wavelength resonators and TE01 resonators.

A "virtual grounding" in the above sense is considered to be achieved if a phase angle between the metallic surfaces and the cavity wall is less than 10° in a typical radio frequency range between 100 MHz and 10 GHz.

The expression "essentially uniform" refers to the fact that the surfaces forming the gap may well be provided with holes or depressions in order to ameliorate the characteristic of the tuning arrangement. Moreover, the gap size may depend on the position of the tuning structures in order to achieve a desired behavior. Further, the size and shape of the gap may differ between the cavities in order to compensate different tuning behavior of the cavities, e.g. in order to avoid a slower tuning of a first and of a last resonator in a series.

The effect exploited by the device allows maximal distance between the tuning structures and the resonators in the cavities. This is in contrast to devices where pieces of dielectric material or grounded metal are moved in close proximity to the resonator. The larger the distance between the tuning structures to the resonator, the better the accuracy of the tuning and the robustness against tolerances.

The gap may be further filled with dielectric material in order to increase the capacitance. The dielectric material may be attached to the metallic surface/electrode of the tuning structure and/or to the top wall of the cavities. For example, PTFE-foil or mica sheets may be provided there between.

Moreover, it is proposed that the tuning structures comprise a plastic base member being at least partially provided with a metal plating forming said first and second metal surfaces. This allows a cheap and easy to manufacture tuning arrangement, wherein the metallic surfaces may also be easily produced with exotic shapes being adapted to achieve a precise, in particular linear tuning characteristic of the tuning arrangement. Unwanted couplings and resonances may be avoided if at least a part of the plastic base member is void of the metal plating. The plastic base member may be formed of a PCB material which is cheap, easy to manufacture and robust. Dielectric losses due to the dielectric plastic material may be avoided by the metal plating. The metal plating preferably has a thickness of more than 5 skin-depths, which translates to 7-12 microns for the most common frequency bands. As plating materials, high conductivity materials such as silver or copper are suitable. The plastic base member may in particular be formed as an injection-mold plastic part.

Moreover, it is proposed that the variable radio frequency band filter is provided with a conductive field blocking element protruding from the wall of the cavity in the vicinity of part of the plastic base member being void of said metal plating. The field blocking element may shield the bare plastic parts of the base member from the electric field such that dielectric losses may be suppressed and that a high Q-factor may be achieved.

A cheap and easily mountable tuning arrangement may be achieved if multiple tuning structures associated with different cavities are formed as one part based on a single plastic base member. In particular, the plastic base member may comprise two stringers or rods extending in the shifting direction of the tuning structures and being connected by bars for laterally connecting the stringers and for stabilizing the plastic base member against deformations.

A specifically precise and easily manufacturable tuning arrangement may be achieved if both the cavity wall facing the second metallic surface and the second metallic surface are flat. The cavity wall may in particular be formed by a lid for closing the cavity from above, i.e. from a side opposite to the wall supporting the resonator.

Moreover, it is proposed that each of the tuning structures is shaped at least essentially symmetrically with regard to a plane parallel to a shifting direction of the tuning structure and essentially comprising a symmetry axis of the resonator, which resonator is preferably of a cylindrical symmetry. Mounting tolerances resulting in a difference between the symmetry axis of the resonator and the symmetry plane of the tuning structures result in an error which is quadratic in this difference such that the arrangement is not very susceptible to tolerances in the parts.

According to one embodiment, it is proposed that the tuning structures includes at least two parts being arranged symmetrically with regard to the above defined plane. A linear or close-to-linear tuning behavior of the tuning structures may be achieved when a lateral distance between the two parts varies in the shifting direction, wherein the variation may be determined such that a suitable tuning behavior is achieved. In particular, the lateral edges of the two parts may enclose a wedge-shaped gap.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
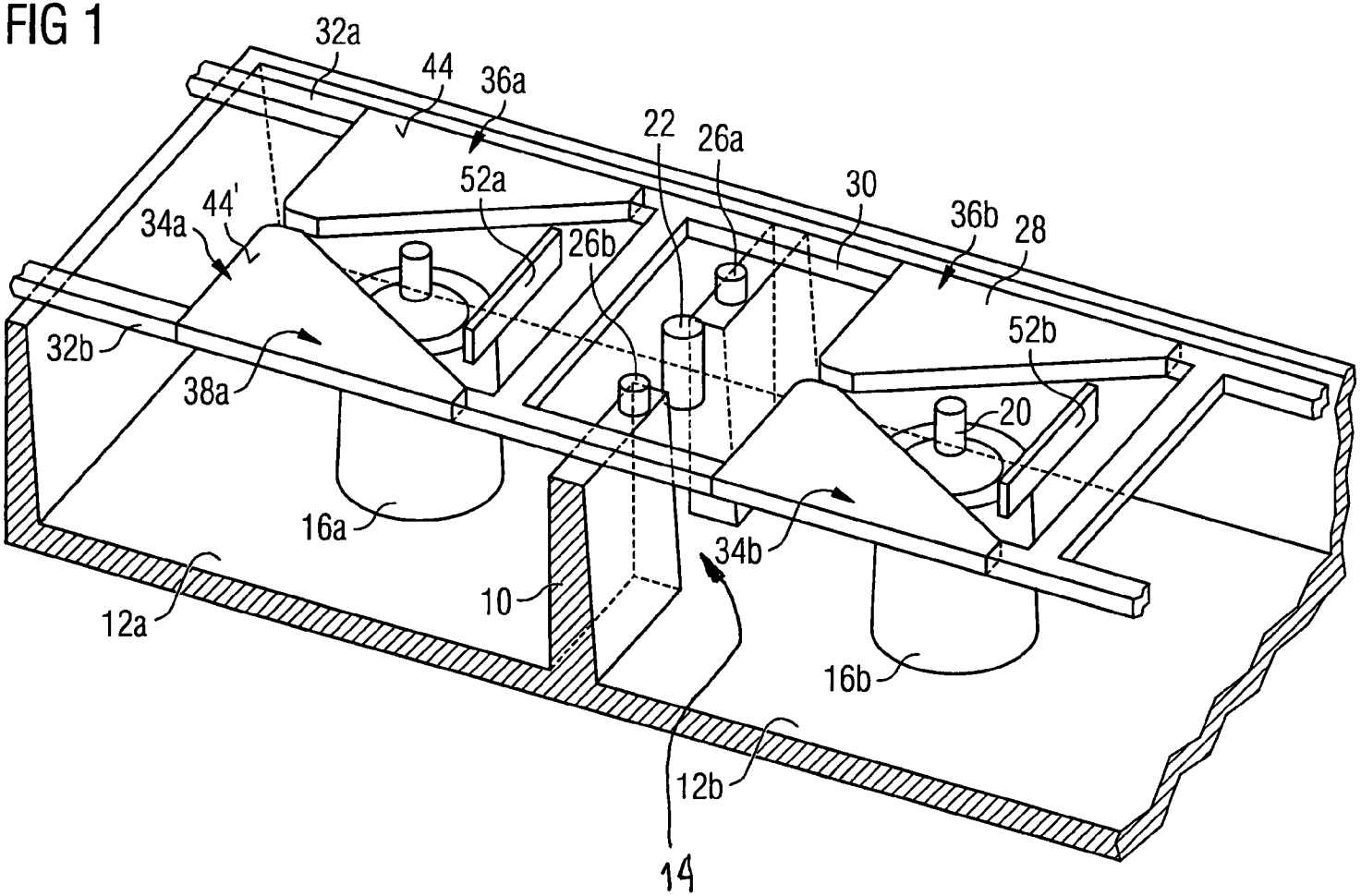
FIG. 1 is a schematic representation of a part of a variable radio frequency band filter with two cavities and a tuning arrangement.

Reference will now be made in detail to the preferred embodiments of the present invention, examples of which are illustrated in the accompanying drawings, wherein like reference numerals refer to like elements throughout.

FIG. 1 shows a variable radio frequency band filter of a quarter-wavelength coaxial resonator filter type in a schematic representation. The variable radio frequency band filter comprises a silver-plated conductive housing 10 with a plurality of cavities 12*a*, 12*b*. In FIG. 1, only two of the cavities 12*a*, 12*b* are shown for simplicity. The cavities are coupled via so-called slits or irises 14 and are each provided with one resonator 16*a*, 16*b* arranged in the center of the cavities 12*a*, 12*b* on the bottom wall thereof. The resonators 16*a*, 16*b* are cylindrical structures having a symmetry axis perpendicular to the bottom wall of the respective cavity 12*a*, 12*b*. The housing 10 is covered by a lid 18 (FIG. 2) which is removed in the representation of FIG. 1. The lid 18 forms the top wall 24 (FIG. 3) of the cavities 12*a*, 12*b* and tuning screws 20, 22 protrude from the top wall 24 (FIG. 2) of the lid 18. A first type of tuning screw 20 is arranged in the symmetry axis of the resonators 16*a*, 16*b* and may be used to tune a resonance frequency of the respective cavity 12*a*, 12*b* and a second type of tuning screw 22 is arranged such that it protrudes into the slit 14 and that a coupling between the neighboring cavities 12*a*, 12*b* can be set to a desired value. Further screws 26*a*, 26*b* are used to fix the lid 18 to the lower part of the housing 10.

The proposed variable radio frequency band filter further comprises a tuning arrangement 28 with a roughly ladder-shaped base member 30 made of plastic or PCB material. The base member 30 comprises two stringers 32*a*, 32*b* arranged below the lid 18 such that the tuning arrangement 28 may be shifted along the longitudinal direction of the stringers 32*a*, 32*b*. The tuning arrangement 28 further comprises plural tuning structures 34*a*, 34*b*, each tuning structure 34*a*, 34*b* being made up of two wing-shaped symmetrical parts 36*a*, 36*b*, 38*a*, 38*b*, wherein the parts 36*a*, 36*b*, 38*a*, 38*b* are formed on the stringers 32*a*, 32*b* such that the parts 36*a*, 36*b*, 38*a*, 38*b* are arranged symmetrically with regard to a plane parallel to the shifting direction of the tuning structures 34*a*, 34*b*, wherein the symmetry plane further comprises the symmetry axis of the resonators 16*a*, 16*b*. A lateral distance between the parts 36*a*, 38*a* and between the parts 36*b*, 38*b* varies in the shifting direction such that lateral edges of respective pairs of parts 36*a*, 38*a*; 36*b*, 38*b* enclose wedge-shaped gaps respectively.

In the region of the parts 36*a*, 36*b*, 38*a*, 38*b*, the base member 30 is plated with a metallic material, e. g. copper. As a consequence, each of the tuning structures 34*a*, 34*b* is provided with a metal plating on both sides of the base member 30, such that each tuning structure 34*a*, 34*b* includes two metallic surfaces 42, 42' facing the resonators 16*a*, 16*b* and the respective cavity 12*a*, 12*b* and two metallic surfaces 44, 44' facing the top wall 24 (FIG. 3) of the respective cavities 12*a*, 12*b*. The latter surfaces 44, 44' shall be referred to as "second metallic surfaces" here and in the following. The conductive plating surrounds the edges of the plastic base member 30 and provides a conductive connection between the upper and lower metallized surfaces 42, 44 and 42', 44'.

Figure 2:
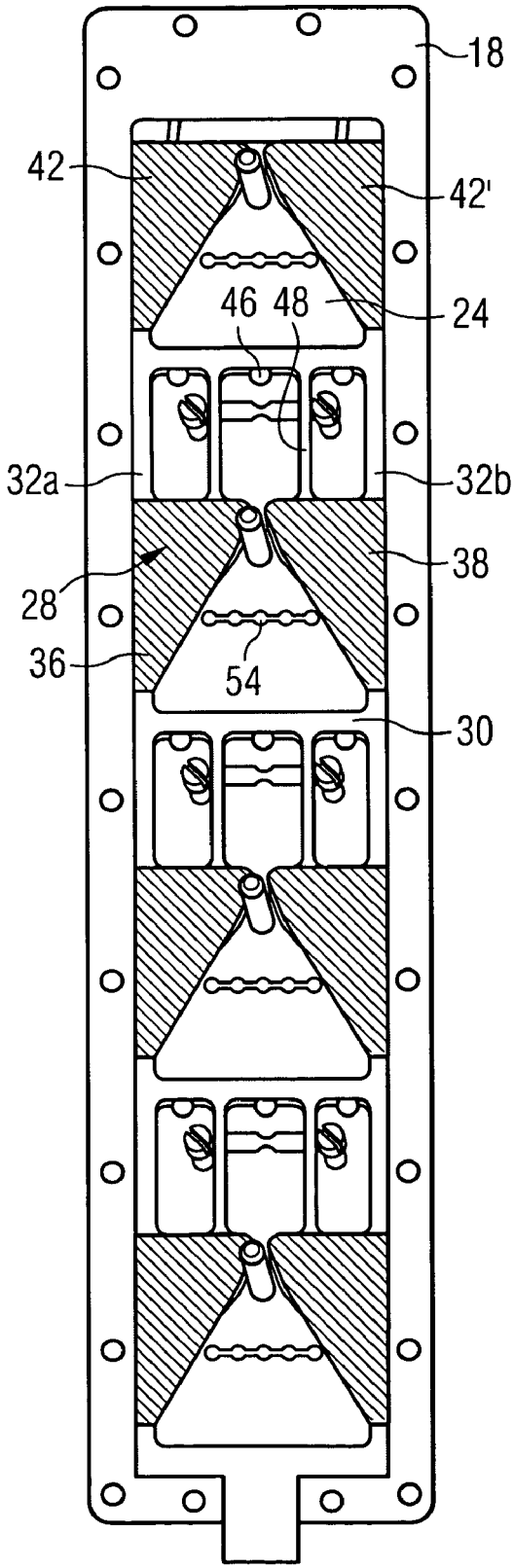
FIG. 2 shows a lid of a variable radio frequency band filter and a tuning arrangement thereof.

FIG. 2 shows the lid 18 and the base member 30 of the tuning arrangement 28 as a whole as seen from inside the cavities 12*a*, 12*b*. The variable radio frequency band filter comprises four cavities and correspondingly four tuning structures of the type shown in FIG. 2. The copper-plated parts of the tuning structures are marked with dashes. The lid 18 forming the top wall 24 of the cavities 12*a*, 12*b* is a simple silver-plated metal plate, such that the top wall 24 is flat. Moreover, the base member 30 as a whole is a flat lattice structure stamped out of flat plastic material such that also the surfaces 42, 42', 44, 44' (FIG. 1, FIG. 3) are also perfectly flat. The base member 30 comprises one pair of stringers 32*a*, 32*b*, wherein the pair of stringers 32*a*, 32*b* is connected by bars 46 for stability reasons. The wing-shaped parts 36, 38 of the larger tuning structures 34 are stabilized by further bars 48 extending parallel to the stringers 32*a*, 32*b*.

Figure 3:
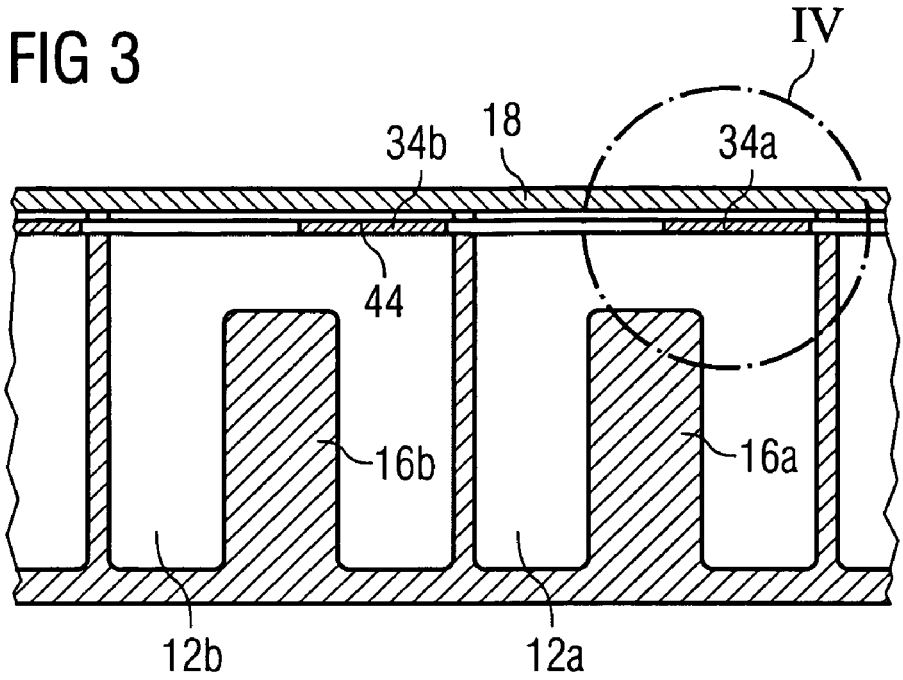
FIG. 3 is a cross-section of the variable radio frequency band filter according to FIGS. 1 and 2.
Figure 4:
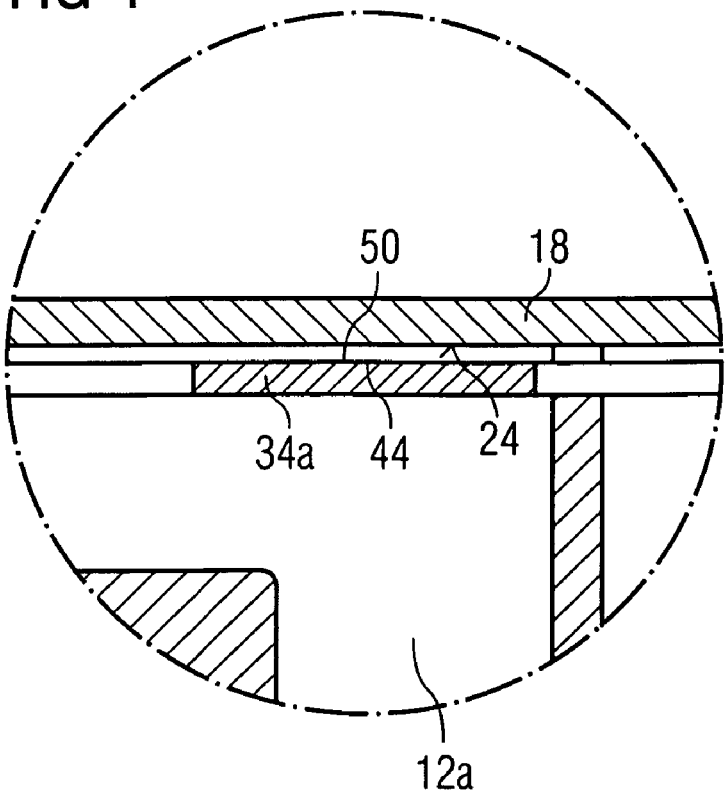
FIG. 4 is a detail of FIG. 3.

As illustrated in FIGS. 3 and 4, a small and uniform gap 50 is formed between the second metallic surface 44, 44' of the tuning structures 34*a*, 34*b* and the top wall 24 of the cavity 12*a*, 12*b*, the top wall 24 being formed by the lid 18. The width of the gap 50 is between 0.25 mm and 1 mm and the area of the parts 36*a*, 36*b*, 38*a*, 38*b* is between 0.25 $cm^2$ and 2 $cm^2$, such that the capacitance of between 3 pF and 15 pF is formed between the second metallic surface 44, 44' and the top wall 24 of the cavity 12*a*, 12*b*.

This capacitance is large enough to strongly couple the tuning structures 34*a*, 34*b* to the cavity wall 24 in the relevant frequency range between some 100 MHz and a few GHz, such that the tuning structures appear to be virtually grounded for the resonators 16*a*, 16*b* and for the microwaves generated by the resonator.

Accordingly, the lower surfaces 42, 42' of the tuning structures effectively act as cavity walls, such that a movement of the tuning structures 34*a*, 34*b* has an effect which is identical to a variation of a shape of the respective cavity 12*a*, 12*b*. In particular, if the tuning structures 34*a*, 34*b* are moved over the resonators 16*a*, 16*b*, the effect is identical to the effect of a reduction of the cavity height. Due to this virtual grounding, dielectric losses due to the tuning structures 34*a*, 34*b* can be almost completely avoided. A physical grounding of the tuning structures 34*a*, 34*b*, which is complicated due to the fact that the tuning structures 34*a*, 34*b* are moveable, is avoided and replaced with a strong capacitive coupling.

Figure 5:
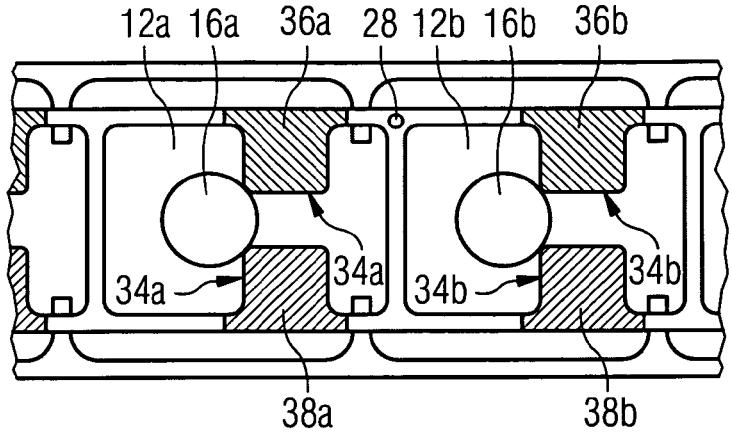
FIG. 5 is a schematic representation of the tuning arrangement according to a further embodiment in a first position.
Figure 6:
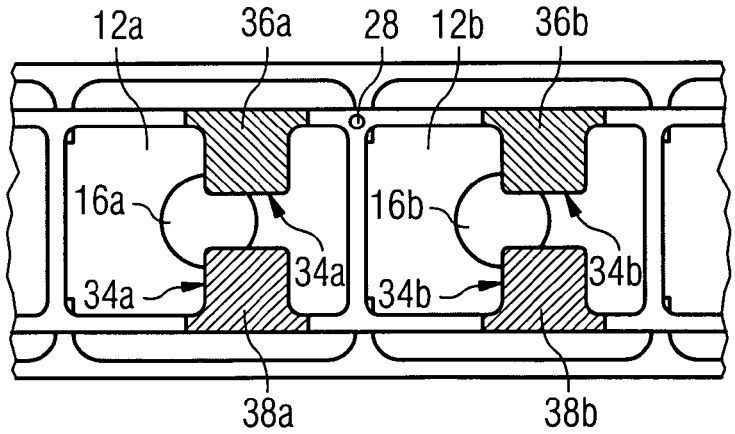
FIG. 6 is a schematic representation of the tuning arrangement according to FIG. 5 in a second position.
Figure 7:
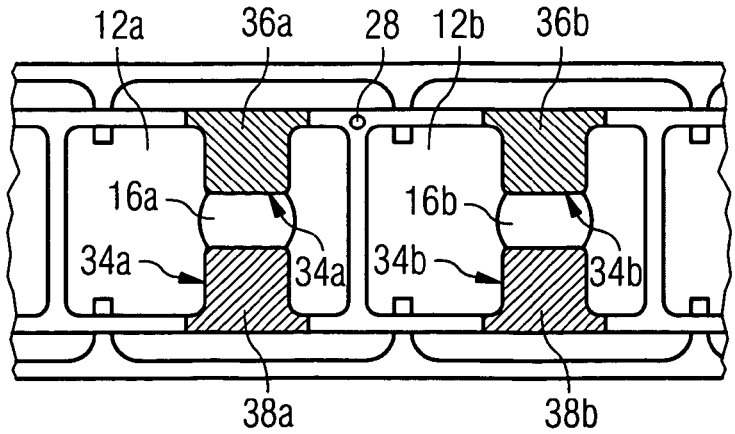
FIG. 7 is a schematic representation of the tuning arrangement according to FIGS. 5 and 6 in a third position.

FIGS. 5 to 7 show a further embodiment of the proposed device, wherein the parts 36*a*, 36*b*, 38*a*, 38*b* of the tuning structures 34*a*, 34*b* are of roughly rectangular structure. FIG. 5 shows a first position of the tuning arrangement 28 corresponding to a high-frequency setting, FIG. 6 shows a second position of the tuning arrangement 28 corresponding to a medium-frequency setting and FIG. 7 shows a third position of the tuning arrangement 28 corresponding to a low-frequency setting.

In either embodiment, the variable radio frequency band filter may comprise a linear actuator for moving the tuning arrangement 28, such that the frequency may be controlled by software.

The parts of the base member 30 interconnecting the tuning structures 34*a*, 34*b* and the bars 46, 48 stabilizing the tuning arrangement 28 are void of metal plating, such that unwanted reflections of the electromagnetic waves may be avoided. According to the embodiment shown in FIG. 1, conductive field blocking elements 52*a*, 52*b* are disposed on the top wall 24 of the cavities 12*a*, 12*b* in the vicinity of the parts of the plastic base member 30 being void of the metal plating. The field blocking elements 52*a*, 52*b* are attached to fixing structures 54 in the form of slits provided in the lid 18 (FIG. 2).

Figure 8:
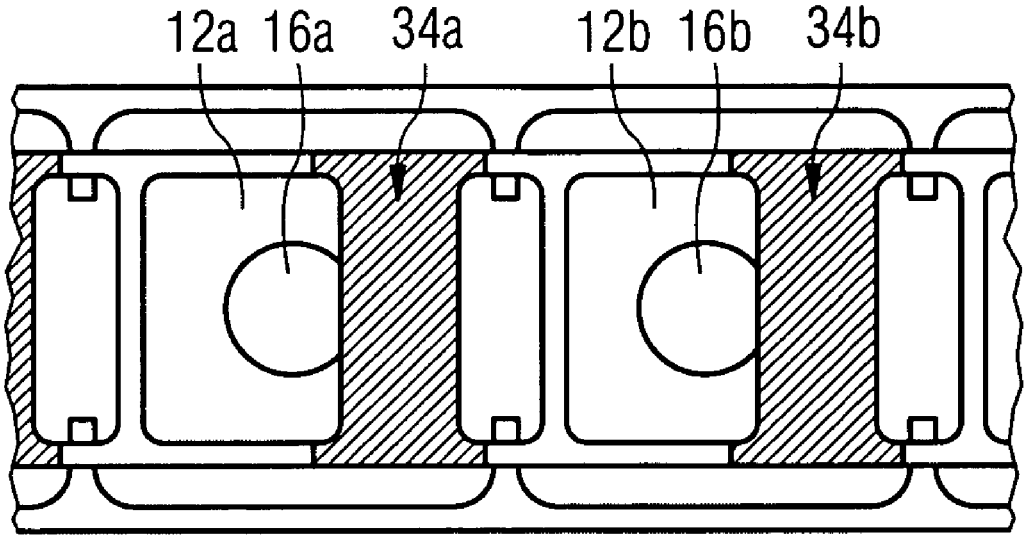
FIG. 8 is a schematic representation of a further embodiment with bar-shaped tuning structures.
Figure 9:
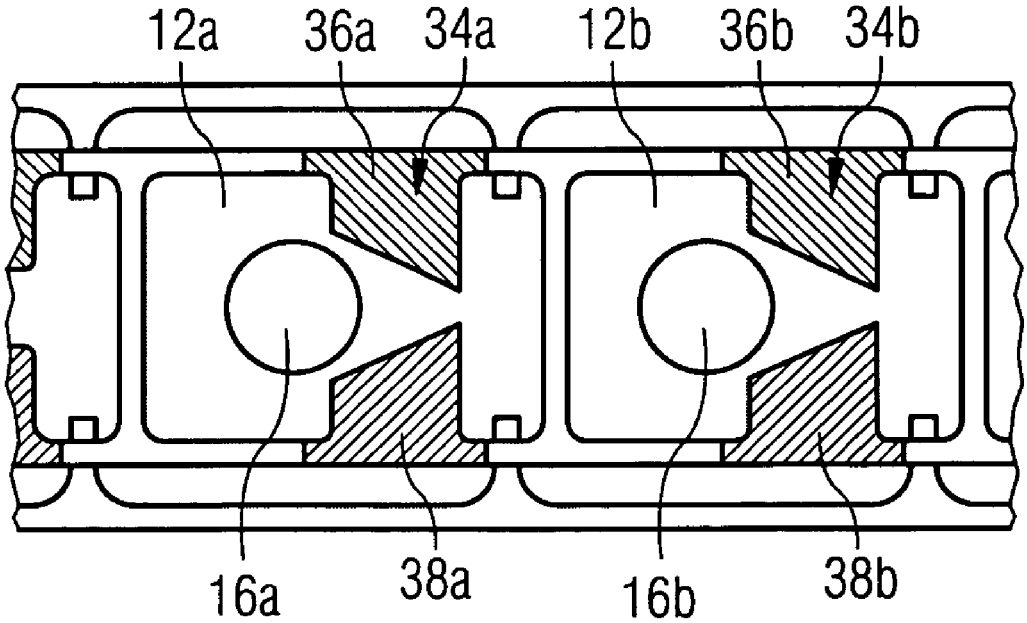
FIG. 9 is a schematic representation of a further embodiment with tuning structures comprising two symmetrical parts enclosing a wedge-shaped gap.

FIGS. 8 and 9 show further embodiments, wherein the tuning structures 34*a*, 34*b* are differently shaped. In FIG. 8, the tuning structures 34*a*, 34*b* are roughly bar-shaped and in FIG. 9, the edges of the parts 36*a*, 36*b*, 38*a*, 38*b* facing the resonators 16*a*, 16*b* are formed as straight lines.

According to a further embodiment (not illustrated), the tuning arrangement including the tuning structures may be placed near the side walls of the cavities in a lateral direction with regard to the symmetry axis of the resonator. According to this embodiment, a very flat tunable radio frequency band filter may be achieved.

Figure 10:
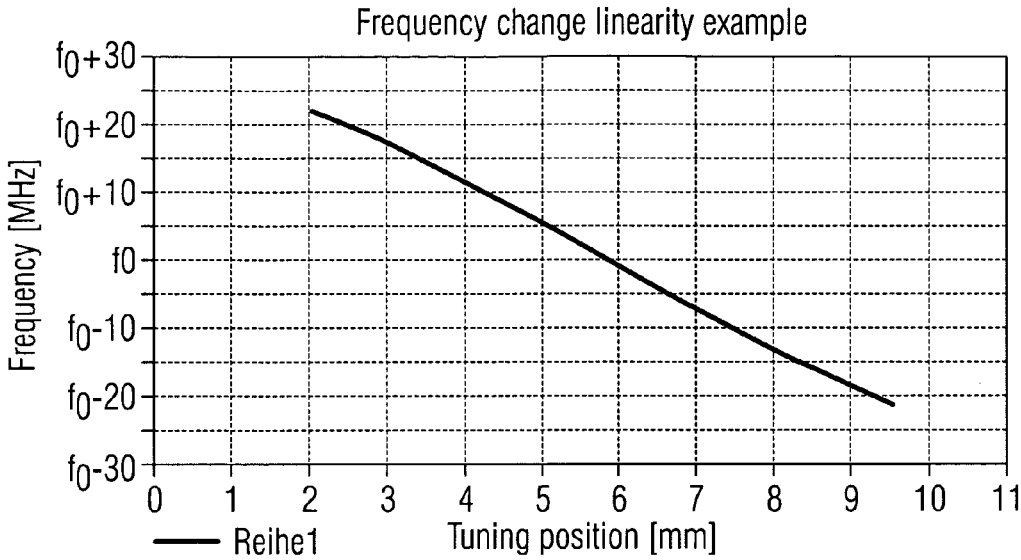
FIG. 10 shows a curve representing the resonance frequency versus the position of the tuning arrangement.

FIG. 10 shows a curve representing the resonance frequency versus the position of the tuning arrangement, which can be continuously shifted in the longitudinal direction. The linearity of the tuning arrangement has been found to be very good over a very wide tuning range. The linearity may be achieved and/or enhanced by choosing a suitable shape for the tuning structures, which may e.g. be found using finite elements simulations.

Figure 11:
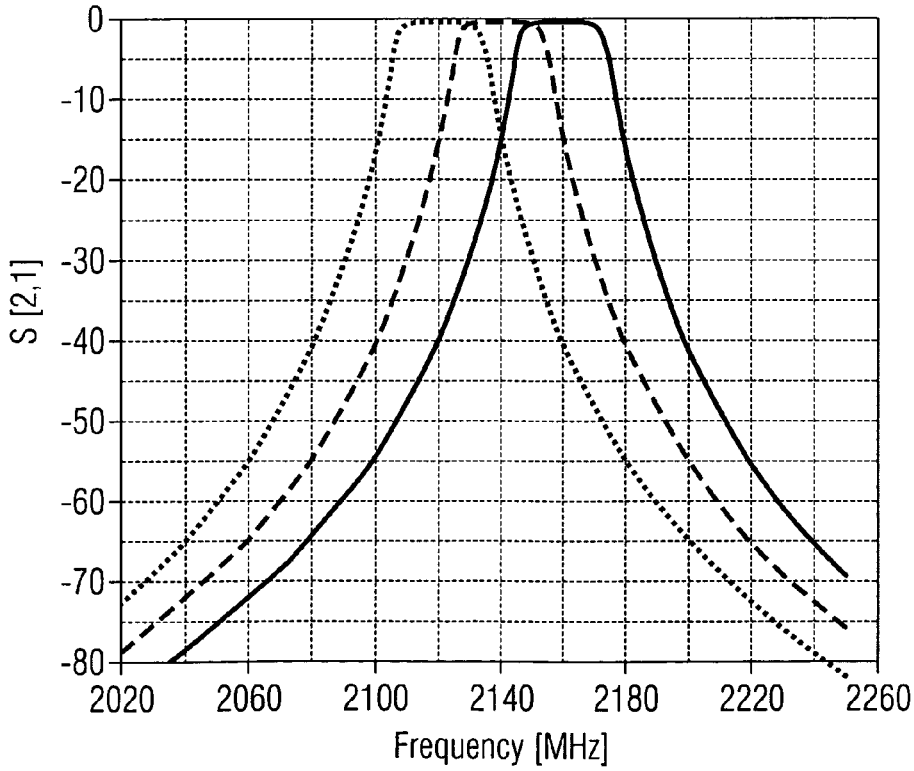
FIG. 11 shows the frequency spectrum of the resonators for the different positions in FIGS. 5 to 7.

FIG. 11 shows the frequency spectrum of the resonators for the different positions in FIGS. 5 to 7. The leftmost and dotted curve corresponds to the low frequency configuration in FIG. 2, the dashed curve corresponds to the medium frequency position in FIG. 6 and the rightmost curve corresponds to the high frequency situation in FIG. 5.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide v. DIRECTV*, 69 USPQ2d 1865 (Fed. Cir. 2004).

What is claimed is:

1. A variable radio frequency band filter comprising:

a housing with a plurality of cavities;

a plurality of resonators, wherein one resonator is arranged in each of the cavities; and a tuning arrangement comprising a plurality of tuning structures with one of the tuning structures being arranged in each of the cavities and wherein the tuning structures of the different cavities are mechanically connected such that the tuning structures may be shifted simultaneously in order to simultaneously vary resonance frequencies of the cavities, and wherein each tuning structure includes at least one first metallic surface facing the resonator and at least one second metallic surface facing a wall of the cavity and physically separated from the wall, the first and second metallic surfaces being conductively connected, the second metallic surface being arranged such that a small and essentially uniform gap is formed between the second metallic surface and the wall in order to achieve a virtual grounding of the metallic surfaces.

2. A variable radio frequency band filter according to claim 1, wherein the gap has a size such that a capacitance formed between the second metallic surface and the wall is at least 3 pF.

3. A variable radio frequency band filter according to claim 1, wherein each of the tuning structures comprise a plastic base member being at least partially provided with a metal plating, and the metal plating forms the first and second metallic surfaces.

4. A variable radio frequency band filter according to claim 3, wherein a part of the plastic base member is void of said metal plating.

5. A variable radio frequency band filter according to claim 4, wherein a conductive field blocking element protrudes from the wall of the cavity in the vicinity of the part of the plastic base member, which is void of metal plating.

6. A variable radio frequency band filter according to claim 3, wherein tuning structures of the different cavities are formed as one part based on a single plastic base member.

7. A variable radio frequency band filter according to claim 6, wherein the tuning structures are mechanically connected for shifting in a shifting direction, said base member comprises two stringers extending in the shifting direction, and the base member has bars for laterally connecting the stringers.

8. A variable radio frequency band filter according to claim 1, wherein the second metallic surface and the cavity wall facing the second metallic surface are flat.

9. A variable radio frequency band filter according to claim 1, wherein the cavity wall facing the second metallic surface is formed by a lid for closing the cavity.

10. A variable radio frequency band filter according to claim 1, wherein each of the resonators has an axis of symmetry, and the tuning structures are mechanically connected for shifting in a shifting direction, each of the tuning structures is shaped essentially symmetrically with regard to a symmetry plane that includes the axes of symmetry of the resonators and that is parallel to the shifting direction.

11. A variable radio frequency band filter according to claim 10, wherein each of the tuning structures includes at least two parts arranged symmetrically with regard to the symmetry plane.

12. A variable radio frequency band filter according to claim 11, wherein the two parts have lateral edges shaped such that a lateral distance between the two parts varies in the shifting direction.

13. A variable radio frequency band filter according to claim 11, wherein the two parts of lateral edges that define and enclose a wedge-shaped gap.

14. A variable radio frequency band filter according to claim 1, wherein the variable radio frequency band filter is formed as a quarter-wavelength coaxial resonator filter.

15. A variable radio frequency band filter according to claim 2, wherein each of the tuning structures comprise a plastic base member being at least partially provided with a metal plating, and the metal plating forms the first and second metallic surfaces.

16. A variable radio frequency band filter according to claim 15, wherein a part of the plastic base member is void of said metal plating.

17. A variable radio frequency band filter according to claim 16, wherein a conductive field blocking element protrudes from the wall of the cavity in the vicinity of the part of the plastic base member, which is void of metal plating.

18. A variable radio frequency band filter according to claim 17, wherein tuning structures of the different cavities are formed as one part based on a single plastic base member.

19. A variable radio frequency band filter according to claim 18, wherein the tuning structures are mechanically connected for shifting in a shifting direction, said base member comprises two stringers extending in the shifting direction, and the base member has bars for laterally connecting the stringers.

20. A variable radio frequency band filter according to claim 19, wherein the second metallic surface and the cavity wall facing the second metallic surface are flat.

21. A variable radio frequency band filter according to claim 20, wherein the cavity wall facing the second metallic surface is formed by a lid for closing the cavity.

22. A variable radio frequency band filter according to claim 21, wherein each of the resonators has an axis of symmetry, and each of the tuning structures is shaped essentially symmetrically with regard to a symmetry plane that includes the axes of symmetry of the resonators and that is parallel to the shifting direction.

23. A variable radio frequency band filter according to claim 22, wherein each of the tuning structures includes at least two parts arranged symmetrically with regard to the symmetry plane.

24. A variable radio frequency band filter according to claim 23, wherein the two parts have lateral edges shaped such that a lateral distance between the two parts varies in the shifting direction.

25. A variable radio frequency band filter according to claim 24, wherein the two parts of lateral edges that define and enclose a wedge-shaped gap.

26. A variable radio frequency band filter according to claim 25, wherein the variable radio frequency band filter is formed as a quarter-wavelength coaxial resonator filter.

* * * * *